United States Patent [19]

Marklew

[11] 3,994,309

[45] Nov. 30, 1976

[54] COIN SEPARATOR

[75] Inventor: Michael Ernest Marklew, Gordon, Australia

[73] Assignee: Data Support Pty. Ltd., Pymble, Australia

[22] Filed: Dec. 13, 1974

[21] Appl. No.: 532,488

[30] Foreign Application Priority Data

Dec. 19, 1973 Australia ..... 6053/73

[52] U.S. Cl. ..... 133/1 R; 133/8 R

[51] Int. Cl.[2] ..... G07D 9/00

[58] Field of Search ..... 133/3 R, 3 A, 3 E, 3 H, 133/8 R, 8 A

[56] References Cited

UNITED STATES PATENTS

| | | | |
|---|---|---|---|
| 1,279,351 | 9/1918 | Jorgensen | 133/3 A |
| 2,635,730 | 4/1953 | Seckula, Sr. | 133/8 R |
| 2,881,975 | 4/1959 | Bower | 133/8 R X |
| 3,253,604 | 5/1966 | Read | 133/8 R |
| 3,326,223 | 6/1967 | Shikanosuke | 133/8 R |
| 3,422,824 | 1/1969 | Persson | 133/3 R |
| 3,848,614 | 11/1974 | Conant | 133/8 R |
| 3,861,408 | 1/1975 | Hatanaka | 133/8 R |

*Primary Examiner*—Allen N. Knowles
*Attorney, Agent, or Firm*—Haseltine, Lake & Waters

[57] ABSTRACT

The present invention relates to a separator for coins, tokens or like objects, the separator comprising a chamber having at least one side wall, an end wall which is rotatable with respect to the side wall, an inlet and an outlet from the chamber, the outlet being located in the side wall adjacent the end wall, and drive means for rotating the end wall, whereby, when a coin or the like entering the chamber contacts the rotating end wall, the coin is thrown to the perimeter of the end wall and is discharged through the outlet from the chamber.

9 Claims, 7 Drawing Figures

COIN SEPARATOR

The present invention relates to separators and particularly, but not exclusively, to a coin separator for use in automatic coin counting machines.

Conventional coin separators operate on a gauging process which relies on the dimensional thickness of the coins which are to be separated. This process has a number of inherent disadvantages which are not conductive to reliable and accurate counting in conventional machines. Coins are usually minted to high dimensional tolerances, however, due to wear and tear in use these dimensions cannot be maintained. Further, in some denominations of coins, two coins, for example, of small denomination, when stacked one upon the other may in combination have the same thickness as a coin of higher denomination. For example in Australia, two 5 cent pieces have approximately the same thickness as one 20 cent piece.

Known coin separators may have two basic forms. The first form comprises a vibratory chute which directs coins to a simple gauge of hardened material which is sized to allow only coins of certain thickness to pass through, the coins once separated may be counted by a number of known ways. This first form is subject of considerable security risk as rubbish of all kinds received with the coins accumulates in the chute and thus requires regular manual maintenance for removal of this rubbish with a consequently high incidence of theft. Further, it is often difficult to remove foreign matter from the gauge which also experiences a problem of high wear resultig in gauge inaccuracy.

The second known form of separator consists of a cambered chute which directs the coins to one side of a flail or lobed rotor. The lobed rotor is axially spaced from the floor of the chute by an amount sufficient to allow one coin at a time to slide between the rotor and the floor of the chute and thereby forming a guage corresponding to the thickness of the coin. The rotor is rotated such that the lobes, which receive the coins, move in the opposite direction to the flow of coins, thus on receiving a stack of coins, all but the bottom coin is thrown aside and likewise with oversized foreign matter such as bottle tops. The separated coins may then be sorted and counted by means of aperture plates or photocells or the like.

This second form is subject to jamming when two coins are received at the rotor, one of which lies on the other at an angle and with an edge thereof on the floor of the chute. Further the speed of operation of the separator is slow and rubbish and foreign matter often rendered the separator inoperative by jamming in the lobed rotor. Vibrators are also necessary to give a smooth flow of coins through the machine.

An object of the present invention is to provide a separator substantially free of the above disadvantages.

The invention in one general form is a separator comprising a chamber having at least one side wall, an end wall which is rotatable with respect to the side wall about an axis, an inlet and an outlet from the chamber, the outlet being located in the side wall adjacent the end wall, and drive means for rotating the end wall.

The outlet may be sized and shaped to receive a range of coin sizes and in itself does not form a gauge by which separation occurs, separation being achieved through contact with the rotating end wall. When a number of coins is deposited into the chamber, momentum is only imparted to the bottom-most coin, there being little or no affect on the remaining coins above. As may be appreciated the speed of separation is much improved.

Some preferred embodiments of the present invention will now be described by way of example with reference to the accompanying drawings wherein.

Figure 1:
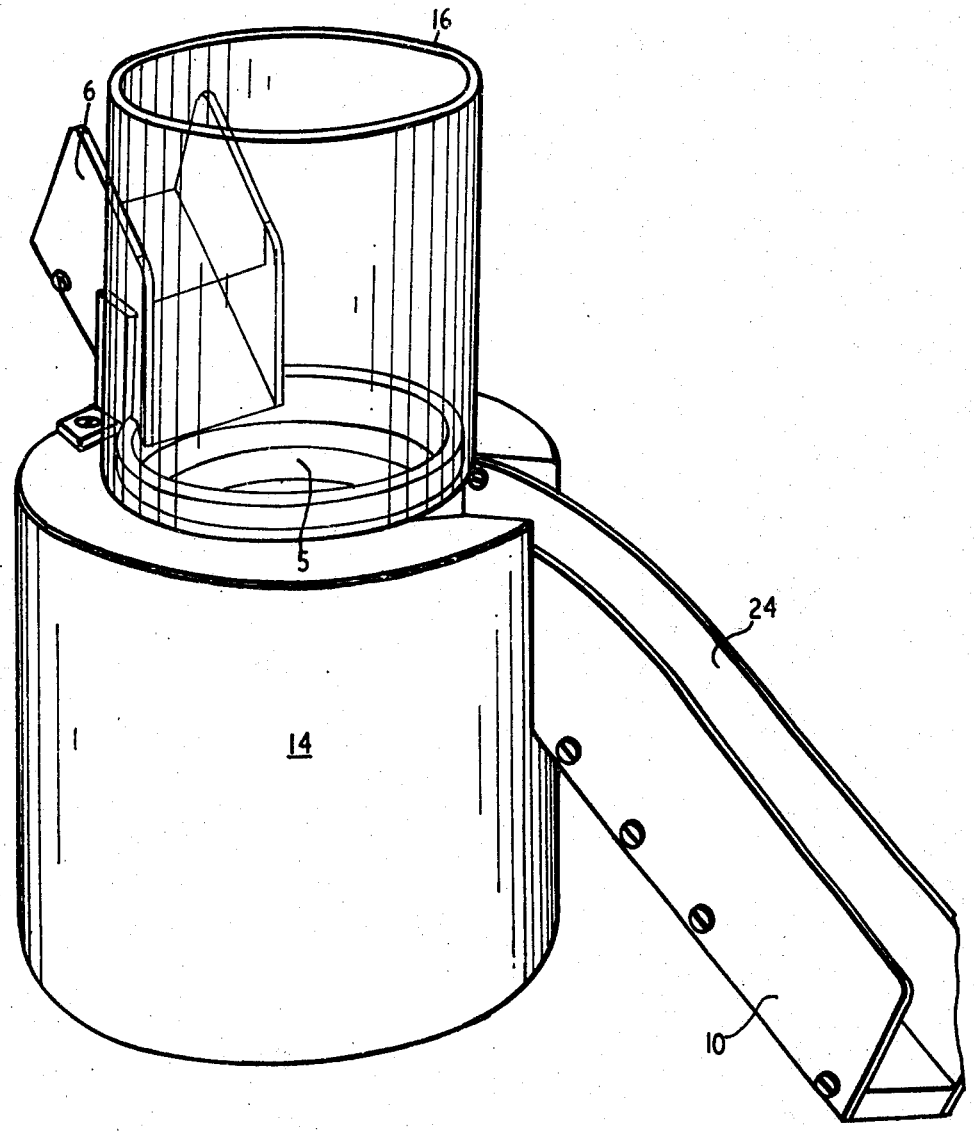
FIG. 1 is a perspective view of a separator according to the present invention.

FIGS. 1, 2, 3 and 4 illustrate a coin separator having a chamber 5 provided with an inlet 6 which is adapted to receive a selection of coins and an outlet 7 from which separated coins are discharged. The end or base wall 8 of the chamber 5 is in the form of a rotating disc 9 and coins discharged from the receiving chute 6 fall onto preferably one side of the rotating disc and each coin on contact with the disc has imparted to it sufficient momentum to throw the coin to the periphery of the chamber in which the outlet or discharge 7 is located.

The spinning disc 9 is preferably formed from a high impact nylon material and is provided with a domed or raised portion 11 at its axis of rotation. This domed portion 11 prevents accumulation of coins at the center of the spinning disc. The chamber peripheral or side wall 12 is also preferably formed from high impact nylon material or the like and may be profiled internally such that the diameter of the peripheral wall converges towards the spinning disc.

The chamber peripheral wall 12 is mounted in a spigot 13 formed in the motor support body 14, the wall 12 being secured within the spigot by means of conventional adhesives or alternatively pressed within the spigot with a tight fit, an upper portion 15 of the peripheral wall extending from the motor support body 14 to form a further spigot which is adapted to receive a sleeve 16 to form an extension of the separator chamber 5. The extension also permits access to the chamber for removal of debris and foreign matter deposited in the separator and at the same time prevents coins from jumping out of the separator during a separating operation. It should be noted that a magnet may be attached at a suitable position in the inlet chute to remove ferrous objects such as washers and the like.

Figure 2:
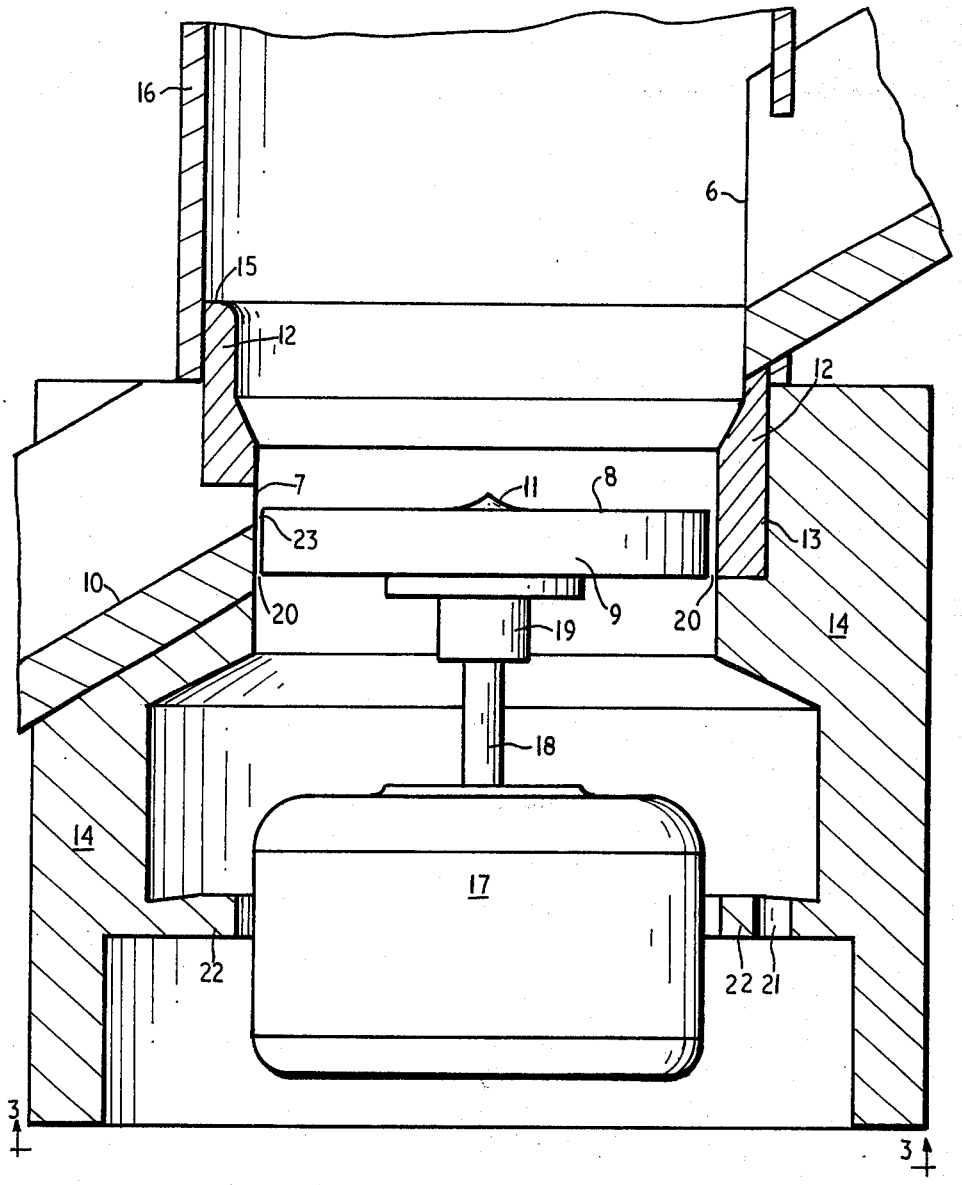
FIG. 2 is a section arrangement of the separator along line 2—2 of FIG. 3.
Figure 3:
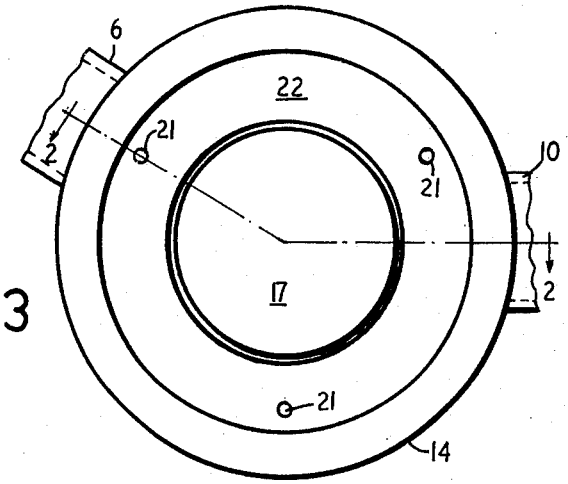
FIG. 3 is an end view of the separator along line 3—3 of FIG. 2.
Figure 4:
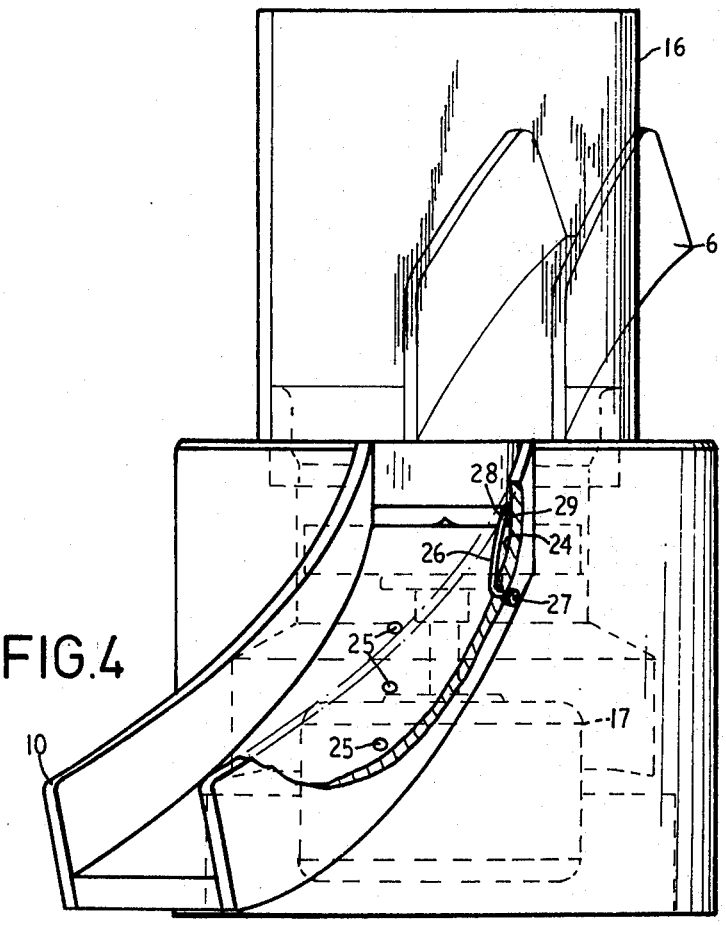
FIG. 4 is a view of portion of FIG. 1 showing an outlet and its associated chute.

An electric motor 17, as shown in FIG. 2, is mounted within the motor support body 14 and connected directly to the spinning disc by means of shaft 18 and hub 19. In the preferred embodiments of the invention the motor operates at approximately 1,700 r.p.m. and the spinning disc 9 is mounted on the driving hub 19 with a push fit so that in the event of the disc being jammed, the disc will slip and the motor is prevented from stalling. A clearance 20 is provided between the spinning disc 9 and the peripheral wall 12 of the chamber to allow liquid matter to pass through the separator without obstructing separatin of coins. The internal walls of the motor support body are also shaped to allow the liquid matter to flow down the surfaces of the internal walls, pass the disc driving motor 17, through drain holes 21 formed in a flanged portin 22 of the body and to discharge to a suitable drain.

In FIG. 2, the outlet 7 from the separator chamber 5 is a slot formed in the peripheral wall 12 of the chamber adjacent the perimeter 23 of the rotating disc. The slot is suitably sized and shaped to receive a range of coin sizes but sufficiently small to exclude certain foreign matter such as bottle tops. The slot does not form an accurate gauging means for separating the coins as occurs in conventional apparatus, but is merely an outlet to receive separated coins from the chamber. Further, the slot is positioned in the flow path line of separated coins to receive the coins without obstruction.

An output slide or chute 10 may be secured adjacent the outlet slot 7 to receive the separated coins for counting. In the preferred embodiments of the invention the outlet chute 10 is curved and cambered such that the discharged and separated coins are caused to slide along the chute and against one inner face or side wall 24 thereof. This face 24 forms a datum face from which a number of photocells 25 or the like may be spaced to guage the sizes of the various denominatins of coins. However, it should be noted that a separator according to the present invention may be adapted for use in combination with a number of conventional coin counting devices which require a supply of separated coins, and therefore the output chute 10 may be straight if required.

In the preferred embodiments of the invention the coins are counted by means of photocells, however, the discharge speed of coins from the separator is sufficiently high to sometimes cause coins to bounce from the datum face of the curved chute 10, in particular when coins of small denomination are counted, and cause inaccuracies in counting. In the embodiments of FIG. 1 to 4 a wire spring 26 is attached at one end 27 to one side wall of the chute and rests at the other end 28 in the coin discharge slot 7 adjacent one edge 29 thereof and causes the impact of the discharged coins to be damped sufficiently to provide a smooth flow of separated coins through the photocell counting device.

Figure 5:
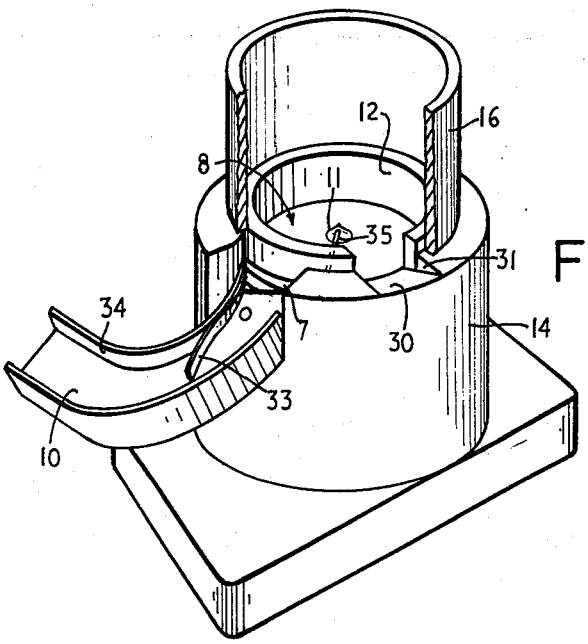
FIG. 5 is a perspective view of a modified form of coin separator having an extension wall in part sectioned.
Figure 6:
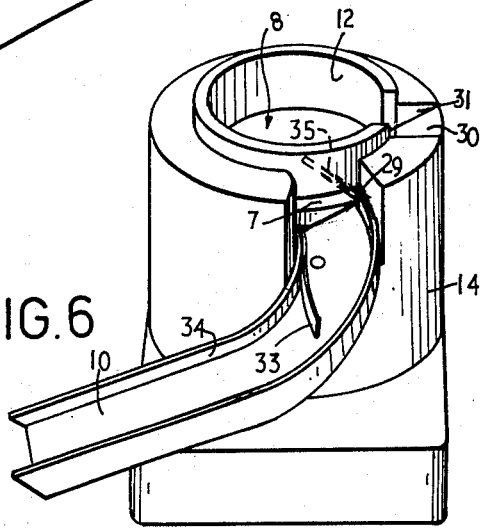
FIG. 6 is another perspective view of the modified form of separator of FIG. 5 with the extension wall removed.
Figure 7:
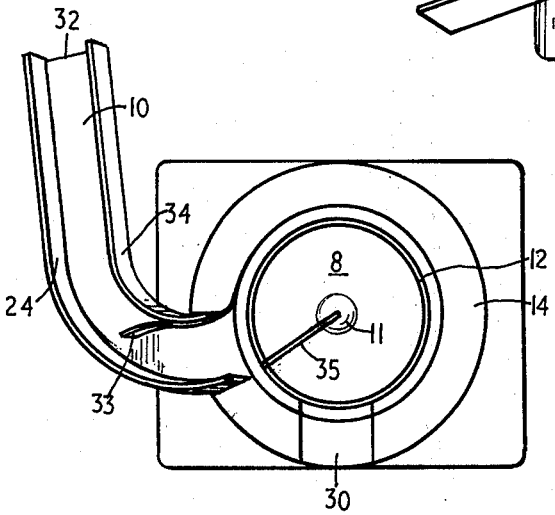
FIG. 7 is a plan view of the modified form of separator illustrated in FIG. 5 and 6.

Turning now to FIGS. 5, 6 and 7, which illustrate a modified form of coin separator, like numerals refer to like parts.

It has been found that with coins of large denomination, improvement in the efficiency of separation may be achieved by arranging the receiving chute at an acute angle with respect to the entry of the discharge chute. In the embodiment of FIGS. 1 to 4, large and heavier coins tend to bounce to and from opposite sides of peripheral wall 12 before discharge through outlet 7, whereas lighter coins tend to discharge more smoothly through outlet 7. If in a particular application of the invention the coins used are predominantly of large denomination, then the embodiment of FIGS. 5 to 7 is preferable, in that the heavier coins generally discharge through outlet 7 after rebounding once from the peripheral wall 12 opposite to the coin inlet 30. For simplicity the receiving chute is not shown in FIGS. 5 to 7, but only a groove 31 in which the chute locates.

In FIGS. 5, 6 and 7, the discharge chute 10 is again curved and cambered but to a greater extent to ensure that the coins are forced to slide edgewise against the datum face 24 of the chute, the end 32 of the chute being aligned in substantially the same direction as the receiving chute. Further the wire spring 26 of the embodiment of FIGS. 1 to 4 may be replaced by a strip 33 of resilient plastics material which is attached adjacent the outlet 7 to side wall 34 of the discharge chute 10. This strip 33 also tends to direct coins against the datum face 24.

To assist smooth and efficient separation of coins a spring wire guide 35 is secured at one end thereof to the separator body 14 ajacent edge 29 of discharge slot 7 and extends towards the axis of rotation of end wall 8. Wire guide 35 is positioned to lie above end wall 8 with a small clearance and tends to dislodge stacked coins. Alternatively and L shaped plate may be used to replace guide 35, the plate being radially aligned in similar manner to guide 35 and lying in a substantially vertical plane. The toe of the L shaped plate is positioned adjacent the end wall 8 to sweep a portin of the end wall at its centre.

It should be noted that the separator and spinning disc 9 may be inclind at an angle to the horizontal without unduly affecting its operation. The power requirements of the separator according to the present invention are less than that required in conventional machines and thus a small motor may be used with effect and with consequent economies of unit production over conventional separators which not only require a substantial power source but also a gear box and vibratory mechanism.

The separator according to the present invention is economical in its simplicity and does not require accurate gauging or toleranced components, its operation is not affected by flooding with water or other liquid matter, which is thrown by the spinning disc to the side walls of the separator chamber down surfaces of which it is permitted to flow to a drain. The coin separator will also operate with a substantial amount of foreign matter such as grit and the like deposited in the separator chamber.

What I claim is:

1. A separator for coins comprising a chamber having at least one side wall; an end wall rotatable with respect to said side wall about an axis; an inlet to and an outlet from said chamber, the latter being located in said side wall adjacent said end wall; drive means for rotating said end wall; a receiving shute connected to said inlet, and a discharge shute connected to said outlet; and coin guide means extending from adjacent one side wall of said discharge shute into said chammber and towards the axis of rotation of said end wall, wherein said coin guide means is a spring wire located near the surface of said end wall, and the free end of which extends towards the axis of rotation of said end wall.

2. A separator for coins comprising a chamber having a cylindrical and substantially upright side wall; an end wall located adjacent a lower end of said side wall, and being rotatable about an axis which is substantially coaxial with said side wall; an inlet to and an outlet from said chamber, the latter being located in said side wall adjacent said end wall, and being shaped to form an elongate slot, a longitudinal side of said slot being aligned substantially parallel to said end wall; a receiving shute connected to said inlet, and a discharge shute connected to said outlet; coin guide means extending from adjacent one side wall of said discharge shute into said chamber and towards the axis of rotation of said end wall, and drive means to cause high-speed rotatin of said end wall, wherein said coin guide means is a spring wire located near the surface of said end wall, and the free end of which extends towards the axis of rotation of said end wall.

3. The separator as defined in claim 2, further comprising a strip of resilient material, a free end of which extends from adjacent said outlet and adjacent another wall of said discharge shute into the latter, and towards said one side wall of the discharge shute, said another wall being remote from said one side wall.

4. The separator as defined in claim 2, wherein an end of said side wall is open, remote from said end wall.

5. The separator as defined in claim 4, further comprising a raised portion on the inside surface of said end wall at the axis of rotation.

6. The separator as defined in claim 5, wherein a clearance is provided between said end wall and said side wall, thereby allowing fluids to drain from said chamber.

7. The separator as defined in claim 6, wherein said side wall is provided with an extension wall extending in a direction away from said end wall.

8. The separator as defined in claim 7, wherein said discharge shute is curved along its length to cause coins discharged therealong to slide edgewise against said one side wall of the discharge shute.

9. The separator as defined in claim 8, further comprising means for gauging the diameter of the coins with respect to said one side wall of the discharge shute.

* * * * *